US008758659B2

(12) United States Patent
Lefevre et al.

(10) Patent No.: US 8,758,659 B2
(45) Date of Patent: Jun. 24, 2014

(54) METHOD OF GROOVING A CHEMICAL-MECHANICAL PLANARIZATION PAD

(75) Inventors: Paul Lefevre, Topsfield, MA (US); Oscar K. Hsu, Chelmsford, MA (US); David Adam Wells, Hudson, NH (US); John Erik Aldeborgh, Boxford, MA (US); Marc C. Jin, Boston, MA (US); Guangwei Wu, Sunnyvale, CA (US); Anoop Mathew, Peabody, MA (US)

(73) Assignee: FNS Tech Co., Ltd., Cheonan-si (KR)

( * ) Notice: Subject to any disclaimer, the term of this patent is extended or adjusted under 35 U.S.C. 154(b) by 186 days.

(21) Appl. No.: 12/893,666

(22) Filed: Sep. 29, 2010

(65) Prior Publication Data

US 2012/0073210 A1 Mar. 29, 2012

(51) Int. Cl.
*B24D 18/00* (2006.01)

(52) U.S. Cl.
USPC ..... 264/138; 264/293; 264/299; 264/342 R; 264/236; 264/347; 264/106; 264/139; 264/162; 264/296; 51/298

(58) Field of Classification Search
USPC ..... 264/236, 293, 299, 342 R, 347, 106, 264/138, 139, 162, 296; 51/298
See application file for complete search history.

(56) References Cited

U.S. PATENT DOCUMENTS

| | | | |
|---|---|---|---|
| 4,671,970 | A | 6/1987 | Keiser et al. |
| 5,605,760 | A | 2/1997 | Roberts |
| 5,893,796 | A | 4/1999 | Birang et al. |
| 5,984,769 | A | 11/1999 | Bennett et al. |
| 6,045,439 | A | 4/2000 | Birang et al. |
| 6,068,539 | A | 5/2000 | Bajaj et al. |
| 6,254,459 | B1 | 7/2001 | Bajaj et al. |
| 6,280,290 | B1 | 8/2001 | Birang et al. |
| 6,517,417 | B2 | 2/2003 | Budinger et al. |
| 6,604,985 | B2 | 8/2003 | Muilenburg et al. |
| 6,621,584 | B2 | 9/2003 | Pecen et al. |
| 6,656,018 | B1 | 12/2003 | Hsu et al. |
| 6,676,483 | B1 | 1/2004 | Roberts |
| 6,752,690 | B1 | 6/2004 | Fruitman |
| 6,786,810 | B2 | 9/2004 | Muilenburg et al. |
| 6,832,947 | B2 | 12/2004 | Manning |
| 6,832,949 | B2 | 12/2004 | Konno et al. |
| 6,832,950 | B2 | 12/2004 | Wright et al. |
| 6,860,793 | B2 | 3/2005 | Budinger et al. |
| 6,910,944 | B2 | 6/2005 | Birang et al. |
| 6,960,120 | B2 | 11/2005 | Prasad |
| 6,964,604 | B2 | 11/2005 | Chen et al. |

(Continued)

OTHER PUBLICATIONS

International Search Report and Written Opinion dated Feb. 21, 2012 from corresponding PCT Application No. PCT/US2011/53870.

*Primary Examiner* — Timothy Kennedy
(74) *Attorney, Agent, or Firm* — Grossman, Tucker, Perreault & Pfleger, PLLC

(57) ABSTRACT

A method of forming a chemical mechanical polishing pad. The method includes polymerizing one or more polymer precursors and forming a chemical-mechanical planarization pad including a surface, forming grooves in the surface defining lands between the grooves, wherein the grooves have a first width, and shrinking the lands from a first land length ($L_1$) at the surface to a second land length ($L_2$) at the surface, wherein the second land length ($L_2$) is less than the first land length ($L_1$) and the grooves have a second width ($W_2$) wherein $(W_1) \leq (X)(W_2)$, wherein (X) has a value in the range of 0.01 to 0.75.

19 Claims, 8 Drawing Sheets

(56) References Cited

U.S. PATENT DOCUMENTS

| | | | | |
|---|---|---|---|---|
| 6,984,163 | B2 | 1/2006 | Roberts | |
| 7,011,565 | B2 | 3/2006 | Birang et al. | |
| 7,118,450 | B2 | 10/2006 | Birang et al. | |
| 7,195,539 | B2 | 3/2007 | Turner et al. | |
| 7,273,407 | B2 | 9/2007 | Saikin | |
| 7,985,121 | B2 | 7/2011 | Lefevre et al. | |
| 2002/0127951 | A1 | 9/2002 | Ishikawa et al. | |
| 2003/0068960 | A1* | 4/2003 | Reinhardt et al. | 264/236 |
| 2004/0082276 | A1 | 4/2004 | Prasad | |
| 2004/0102141 | A1 | 5/2004 | Swisher et al. | |
| 2004/0209066 | A1 | 10/2004 | Swisher et al. | |
| 2004/0224611 | A1 | 11/2004 | Aoi et al. | |
| 2006/0166608 | A1 | 7/2006 | Chalmers et al. | |
| 2006/0276109 | A1 | 12/2006 | Roy et al. | |
| 2008/0157248 | A1 | 7/2008 | Yun | |
| 2008/0211141 | A1* | 9/2008 | Deopura et al. | 264/331.19 |
| 2009/0142989 | A1 | 6/2009 | Lefevre et al. | |
| 2009/0246504 | A1 | 10/2009 | Lefevre et al. | |

* cited by examiner

METHOD OF GROOVING A CHEMICAL-MECHANICAL PLANARIZATION PAD

FIELD OF THE INVENTION

The present invention relates to a method of forming grooves on polishing pads that are useful in chemical-mechanical planarization (CMP) of semiconductor wafers. The individual pads may optionally include an end point detection window or a grid network embedded in a continuous polymer matrix.

BACKGROUND

Semiconductor devices are formed from a flat, thin wafer of a semiconductor material, such as silicon. As the devices and layers of interconnecting circuits are deposited on the wafer, each layer must be polished to achieve a sufficiently flat surface with minimal defects before the next layer can be deposited. A variety of chemical, electrochemical, and chemical mechanical polishing techniques are employed to polish the wafers.

In chemical mechanical polishing (CMP), a polishing pad made of polymer material, such as a polyurethane, may be used in conjunction with a slurry to polish the wafers. The slurry comprises abrasive particles, such as aluminum oxide, cerium oxide, or silica particles, dispersed in an aqueous medium. The abrasive particles generally range in size from 20 to 200 nanometers (nm). Other agents, such as surface acting agents, oxidizing agents, or pH regulators, are typically present in the slurry. The pad may also be textured, such as with grooves or perforations, to aid in the distribution of the slurry across the pad and wafer and removal of the slurry and by products therefrom.

For example, in U.S. Pat. No. 6,656,018, whose teachings are incorporated herein by reference, a pad for polishing a substrate in the presence of a slurry is disclosed, where the slurry may contain abrasive particles and a dispersive agent. The pad itself may include a work surface and a backing surface. The pad may be formed from a two-component system, a first component comprising a soluble component, a second component comprising a polymer matrix component, where the soluble component is distributed throughout at least an upper portion of the working structure and the soluble component may include fibrous materials soluble in the slurry to form a void structure in the work surface.

It is useful to end the CMP process when the desired amount of material has been removed from the surface of the substrate. In some systems, the CMP process is continually monitored throughout in order to determine when the desired amount of material has been removed from the surface of the substrate, without stopping the process. This is typically done by in-situ optical end-point detection. In-situ optical end-point detection involves projecting optical (or some other) light through an aperture or a window in the polishing pad from the platen side so that the optical light is reflected off the polished surface of the substrate and is collected by a detector to monitor the progress of planarizaton of the wafer surface.

SUMMARY

An aspect of the present application relates to a method of forming a chemical mechanical polishing pad. The method may include polymerizing one or more polymer precursors and forming a chemical-mechanical planarization pad including a surface. The method may also include forming grooves in the surface defining lands between the grooves, wherein the grooves have a first width. In addition the method may include shrinking the lands from a first land length ($L_1$) at the surface to a second land length ($L_2$) at the surface, wherein the second land length ($L_2$) is less than the first land length ($L_1$) and the grooves have a second width ($W_2$) wherein ($W_1$)≤(X)($W_2$), wherein (X) has a value in the range of 0.01 to 0.75.

Another aspect of the present disclosure relates to a method of forming chemical-mechanical planarization pad. The method may include forming a chemical-mechanical planarization pad including a surface, wherein the chemical-mechanical planarization pad is formed by polymerizing polymer precursors to a selected degree of conversion. The method may also include forming one or more grooves into the surface of the chemical-mechanical planarization pad, wherein the grooves have a first width ($W_1$) and a first depth ($D_1$) and define lands between the grooves. In addition, the method may include thermally treating the chemical-mechanical planarization pad with the grooves formed in the surface, increasing the degree of conversion, and shrinking the lands wherein the grooves exhibit a second width ($W_2$) and a second depth ($D_2$), wherein the second width ($W_2$) is greater than the first width ($W_1$) and the second depth ($D_2$) is greater than the first depth ($D_1$).

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
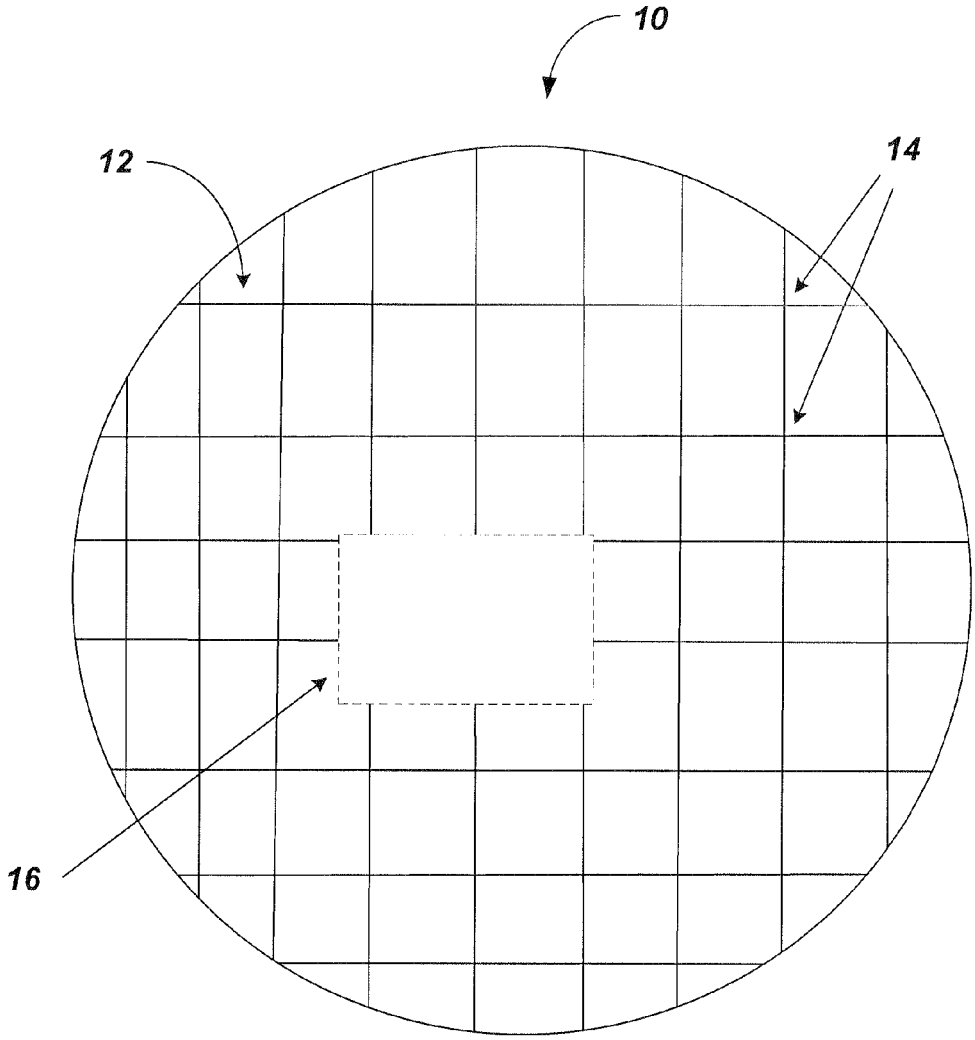
FIG. 1 illustrates an example of a polishing pad.

The present application relates to a chemical-mechanical planarization (CMP) pad and a method of forming a CMP pad. One example of a polishing pad herein is illustrated in FIG. 1. As shown, the pad 10 may optionally include an embedded structure 12, discussed more fully below, which structure may define a plurality of intersection locations 14, dispersed in a pad polymer matrix. In addition, the embedded structure may be provided such that it includes one or more window regions 16 where the embedded structure is not present.

The polymer matrix may be selected from a polymer resin that is capable of providing optical end point detection via use of a laser or some other light through the window 16 that is then reflected off of the polished surface of a substrate. Thus, the polymer matrix may be capable of transmitting at least a portion of incident radiation, including optical radiation. Incident radiation may be understood as radiation, such as light, which impinges on the surface of the polymer matrix. At least 1% or more of the radiation may be transmitted through a portion of the polymer matrix, such as through the thickness of the pad, including all values and increments in the range of 1% to 99%.

Figure 2:
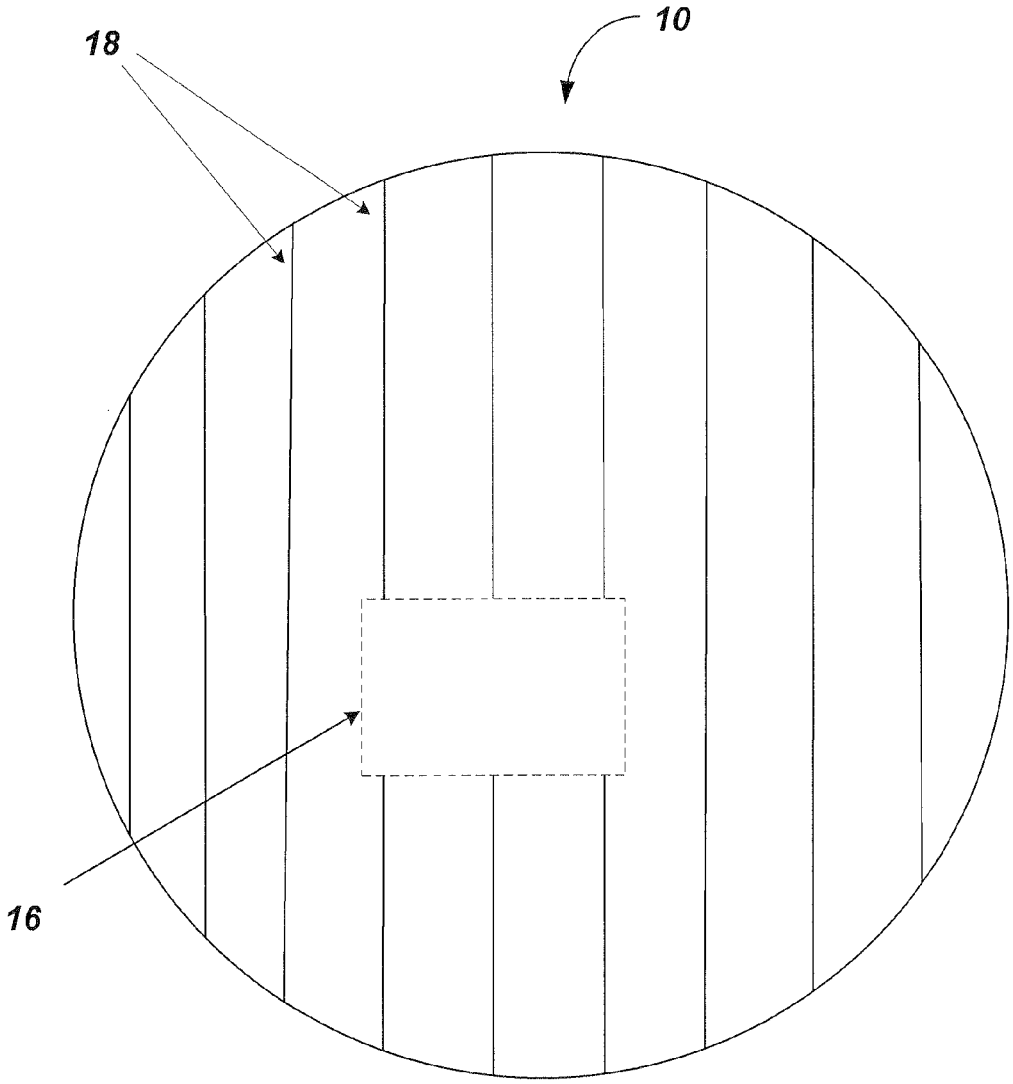
FIG. 2 illustrates an embedded structure included in a polishing pad.

The window 16 may assume any desired geometry, such as round, oval, square, rectangular, polyhedral, etc. In addition, as illustrated in FIG. 2, the embedded structure may also amount to a non-interconnecting type pattern 18 which again includes a window region 16. The embedded structure may also amount to a random type pattern.

The embedded structure itself may be composed of fibers, more specifically in the form of a nonwoven, woven, and/or knitted fabric type configuration. Such network of fibers may enhance certain features of the pad. Such features may include, e.g., pad surface hardness and/or bulk modulus and/or rigidity. In addition, the fiber network may be configured so that it enhances such features differently, as may be desired for a given polishing pad product. Therefore, the pads herein may be configured as desired to provide better global uniformity and local planarity of the polished semiconductor wafer, as well as window end-point detection capability. Expanding upon the above, other available materials for embedded structure may include open-cell polymeric foams and sponges, polymeric filters (e.g. filter paper and fibrous filters) grids and screens. The embedded structure may therefore have a defined two dimensional or three-dimensional pattern. The embedded structure therefore may be understood as any material dispersed in the pad with a selective region where the structure is not present, which region defines a window location for end point detection of a given polishing operation. In additional embodiments, the embedded structure may include particles dispersed throughout the body of the pad. The particles may interconnect or contact forming a network or may be relatively isolated.

As may now be appreciated, by incorporating an embedded structure into the polymer matrix that is used to form the pad, such that a window is provided that may be considered integral to the pad structure (i.e. the pad being of unitary construction), one may avoid some of the problems associated with separately installing a window into the pad after it has been formed. For example, when manufacturing a pad to include a window, one may typically cut an opening in the pad and install a transparent section of material. However, this may then lead to leakage of the slurry due to improper installation around the edges of the window insert.

The polymeric substances, as well as the embedded structure, may be sourced from, but not be limited to, a variety of specific polymeric resins. For example, the polymeric resins may include polyvinylalcohol, polyacrylate, polyacrylic acids, hydroxyethylcellulose, hydroxylmethylcellulose, methylcellulose, carboxymethylcellulose, polyethylene glycol, starch, maleic acid copolymer, polysaccharide, pectin, alginate, polyurethane, polyethylene oxide, polycarbonate, polyester, polyamide, polypropylene, polyacrylamide, polyamines, as well as any copolymers and derivatives of the above resins.

In some embodiments, where the polymer matrix may be formed of polyurethane, pre-polymers such as MDI- or TDI-terminated polyester or polyether pre-polymers may be combined with a cross-linking or curing agent. Examples of polyurethane pre-polymers may be sourced from ADIPRENE LF 750D from Chemtura, IMUTHANE APC-504 from COIM and mixtures thereof. Curing agents may include or bis- or tri-functional amines, 4,4'-methylene-bis-(o-chloroaniline) or other bi- or tri-functional curing agents.

The CMP pad may be formed by a number of processes. For example, the CMP pads may be formed by molding the pads using injection molding or casting. When adding an embedded structure, the embedded structure may first be placed into a mold prior to filling the mold with the polymer matrix. Depending on the polymer materials, and particularly in using pre-polymers, the polymer matrix may need to be cured to obtain a solid structure. Curing may occur in an oven or other heated environment at temperatures and over time periods sufficient to allow for the polymer matrix to react. In some embodiments, the polymer matrix may cure at 150° F. to 250° F. (65° C. to 122° C.), including all values or ranges therein, such as 210° F. (99° C.), over a time period of 10 hours to 30 hours, including all values and ranges therein, such as 16 hours to 24 hours. The CMP pad, and particularly the polymer matrix, may exhibit a degree of conversion in the range of 98.00% or greater, including all values and ranges in the range of 98.00% to 99.9% upon formation of the overall pad shape. Once formed the surface of the CMP pads may be buffed to remove extraneous surface features.

Figure 3:
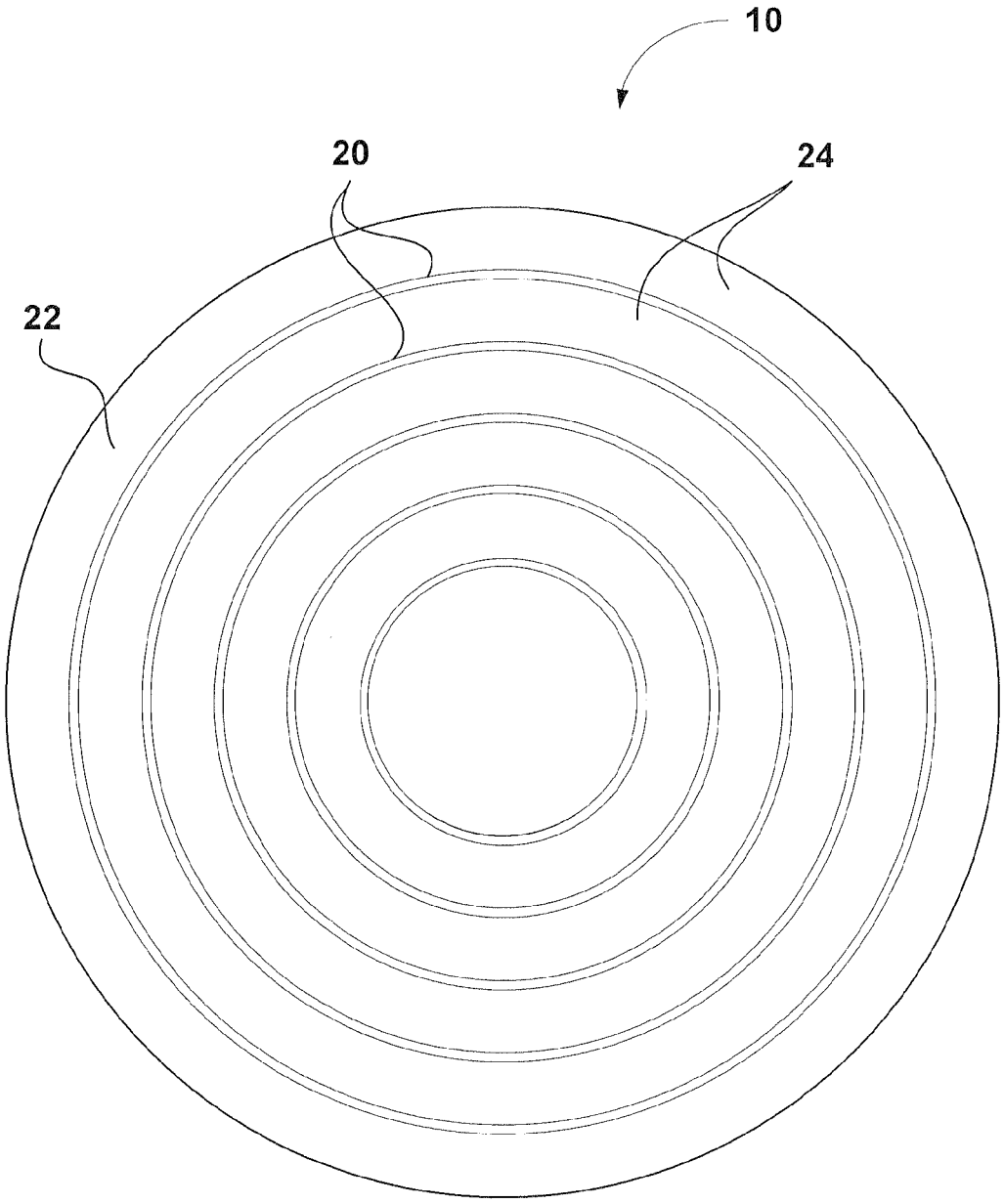
FIG. 3 illustrates a top view of an example of a polishing pad.

As illustrated in FIG. 3, the pads 10 herein may optionally include one or more grooves 20 on at least one surface 22, wherein the grooves 20 may define lands 24 therebetween at or near the surface 22. For example, the grooves may be formed on the working surface of the pad, which surface contacts the object to be polished or planarized. Such grooving may be applied to the window based pads noted above, and or even to pads that do not include such a window configuration. A variety of groove patterns, such as concentric, spiral, log positive and negative (counterclockwise and clockwise) and or combinations thereof, may be formed on the pads. The final groove dimensions may include a depth of 0.004 mils (0.10 μm) and above, a width of 0.004 mils (0.10 μm) and above, and a pitch (distance from center to center of adjacent grooves) of 0.004 mils (0.10 μm) and above. For example, the pads herein may contain final groove depths of 2 mils to 197 mils (50 μm to 5000 μm), final widths of 2 mils to 197 mils (50 μm to 5000 μm) and a final pitch of 2 mils to 102 mils (50 μm to 2600 μm). For all of these values, it should be understood that the present disclosure includes all values and increments within the particular range recited. In particular, the pitch of the grooves herein may have a value of 59 mils to 89 mils (1500 microns to 2250 microns), including all values and increments therein.

The present disclosure recognizes that any of the physical features noted above, which are cut or developed in the pad, may be initially provided at a dimension that is less than the final dimension desired. The final dimensions may then be developed in the pad by causing a physical change in the dimensions of the pad, such as causing the pad to shrink due to thermal treatment such that the desired physical feature (e.g. final groove width and/or depth and/or length and/or pitch) is then provided.

Accordingly, in one embodiment, grooving of the CMP pad may include cutting grooves into the pad having a first set of dimensions (including, for example, depth, length, width, volume and/or pitch) and exposing the cut pad to a heated liquid or gaseous medium or media. Upon exposure to the heated liquid or gaseous medium, the CMP pad may undergo a size change thereby altering the size of the grooves (depth, length, and/or width). Cooling may then fix such size change such that the pad now contains a final groove dimension for efficient CMP polishing. It should also be noted that the size change may be the result of a further polymerization of any polymer precursors utilized to form the pad and/or the size change may be the result of a thermal contraction of the components used to form the pad.

Therefore, it may be appreciated that after forming and curing a CMP pad to provide an overall shape to the pad, the CMP pad may be cut utilizing a cutting device such as routers, lathe cutting blades, milling cutters or other cutting systems. The overall shape of the pad may include the pad's external dimensions, such as outer diameter, thickness, etc. As noted above, one or more grooves of various geometries may be cut into a pad including criss-cross grooves, parallel line grooves or concentric ring grooves, such as illustrated in FIG. 3. Other geometries may be provided as well, including spirals extending over a portion or the entire pad surface, chevrons spaced in uniform or non-uniform repeating patterns, random patterns or combinations thereof.

Figure 4:
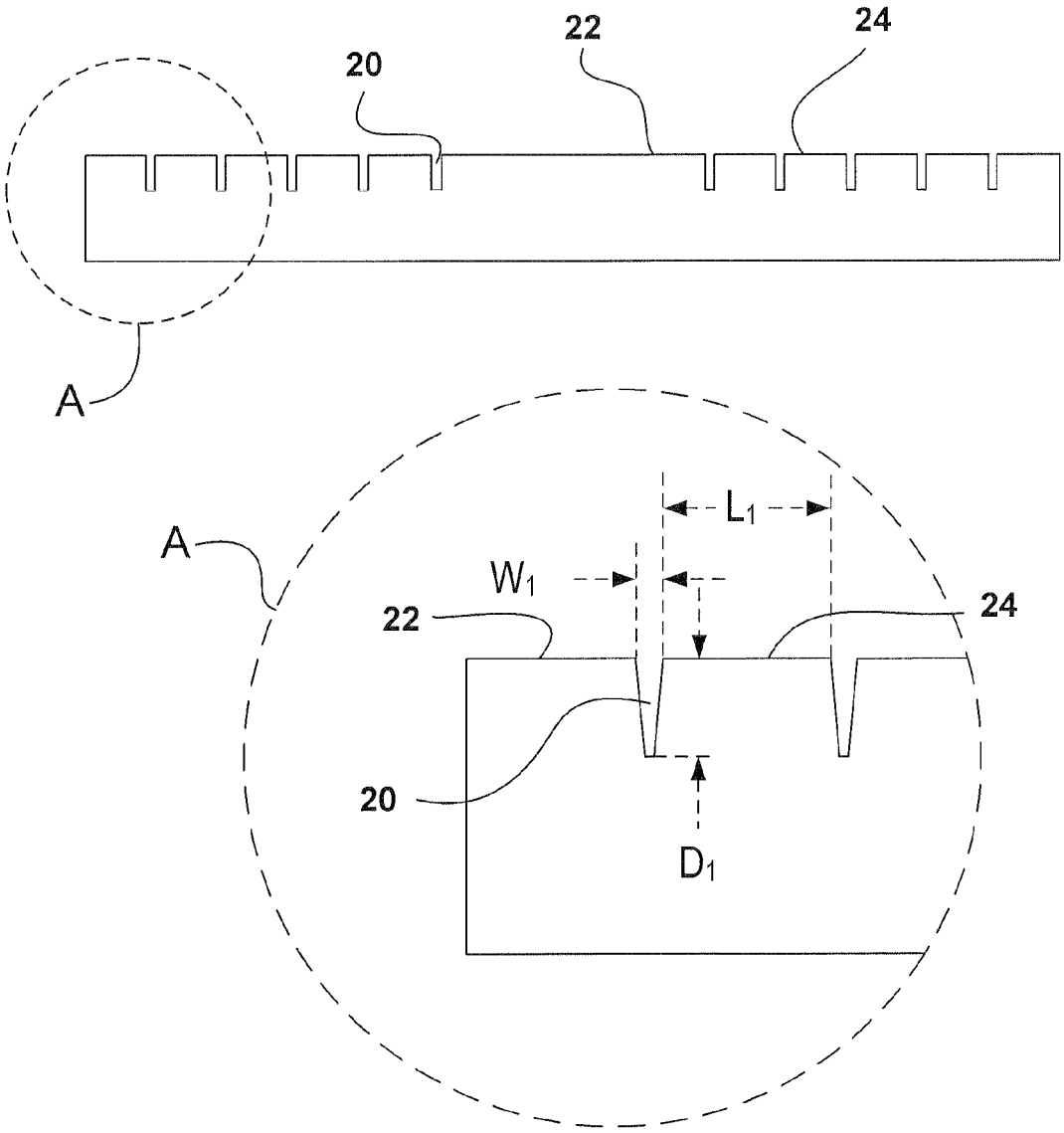
FIG. 4 illustrates a cross-sectional view of the polishing pad of FIG. 3, and a close-up thereof, prior to thermal annealing.

An example of various features of a groove is illustrated in FIG. 4, a cross section of FIG. 3. Upon being cut into the CMP surface 22, the initial grooves may generally have a width $W_1$, a depth $D_1$ and a landing $L_1$. The width $W_1$ may be understood as being the distance between the walls defining a groove at the point that the groove intersects the surface 22. The cut groove width may be in the range of 1 mil to 30 mils (25.4 μm to 762 μm), including all values and ranges therein, such as 5 mils to 10 mils (127 μm to 254 μm), 6 mils to 12 mils (152.4 μm to 304.8 μm), ca. 10 mils (254 μm), etc. In some embodiments, the width may vary along the groove depth $D_1$, being either more narrow or wider towards the bottom of the groove. The cut groove depth $D_1$ may be understood as the distance from the bottom of the groove to the point where the groove intersects the surface 22. The groove depth may be in the range of 10 mils to 80 mils (254 μm to 2032 μm), including all values and ranges therein, such as 30 mils (762 μm), 40 mils (1016 μm), 60 mils (1524 μm), etc. In some embodiments, the cut groove depth may be one-third to one-half of the total pad thickness. Groove landings $L_1$ may be understood as the distance between adjacent walls of adjacent grooves along, or substantially parallel to, the CMP pad surface 22. In addition, an overall void volume or groove volume may be defined by the grooves in the surface 22 of the CMP.

The cutting device may cut the grooves using various cutting bit geometries resulting in grooves with various shapes. In one embodiment, the cutting bit may have a tapered cutter and/or shaft, forming a "V" shaped groove having a pointed bottom. In another embodiment, at least a portion of the cutting bit may have a flat cutting surface, forming a "U" shaped groove with either sharp corners or corners having a radius. Thus, the bottom of the groove may be flat, pointed, rounded or assume a number of other geometries.

Once the initial cut groove geometry has been fashioned in the CMP pad, the CMP pad may be thermally treated. To thermally treat the CMP pad, the CMP pad may be partially or completely immersed in a heated environment and then cooled. Heating may occur at a sufficient temperature and for a sufficient duration to allow for the CMP pad to cure and eventually contract in size. Accordingly, in some embodiments, cooling may occur at a rate sufficient to allow for negative thermal expansion (or contraction) of the polymer matrix. In other embodiments, cooling may occur at a rate sufficient to quench the CMP pad in the thermally expanded state.

In one embodiment, the CMP pad may be placed into a liquid bath, such as a de-ionized water bath or oven, such as a convection oven. The bath or oven temperature may be in the range of 110° F. to 400° F. (43° C. to 205° C.), including all values and ranges therein such as 160° F. to 190° F. (71° C. to 88° C.), etc. The pad may be immersed for 10 hours or more, such as 10 hours to 120 hours including all values and ranges therein, such as 16 hours to 90 hours. When utilizing an oven, a vacuum may be drawn within the oven, or an inert gas or gas mixture may be provided within the oven. Inert gasses may include nitrogen, argon, etc. Pressure may also be applied to the CMP pad while the CMP pad is heated. For example, pressure may be applied to the pad through the liquid in the liquid bath, through gasses within an oven or through the use of a press. Pressure may be maintained through all or a portion of the heating cycle. For example, in one embodiment, pressure may be applied at or towards the end of the heating cycle.

After heating, the CMP pad may be cooled. Cooling may occur simply upon removing the CMP pad from the heated environment and storing the CMP pad at ambient temperatures. In other embodiments, cooling may also occur in stages, wherein the CMP pad may be held at one or more intermediate temperatures for a given time period. An intermediate temperature may be understood as a temperature between ambient temperature and the maximum heating temperature. Cooling may be performed in a liquid bath or an oven, such as a convection oven.

In one embodiment, the cooling temperature may be in the range of 80° F. to 150° F. (26° C. to 66° C.), including all values and increments therein, such as 100° F. to 130° F. (37° C. to 55° C.), etc. Cooling may take place for 10 minute or more, such as in the range of 10 minutes to 120 minutes, etc. The CMP pad may then be exposed to ambient temperatures of 68° F. to 77° F. (20° C. to 25° C.) until use or further processing. The CMP pads may be exposed to additional annealing processes or thermal cycles as well, which may occur before or after the CMP pad is allowed to cool to ambient temperatures.

Figure 5:
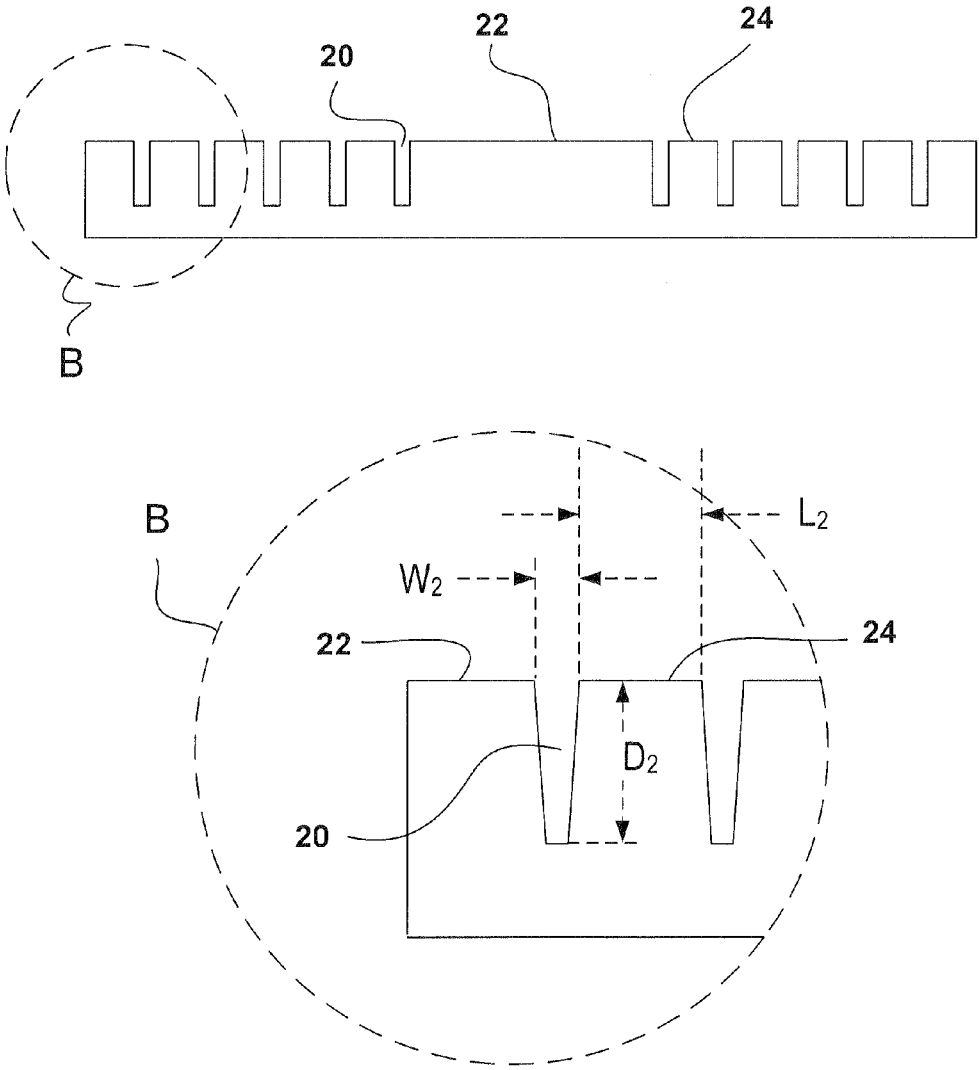
FIG. 5 illustrates a cross-sectional view of the polishing pad of FIG. 3, and a close-up thereof, after thermal annealing.

During the thermal treatment and cooling processes, the CMP pad may undergo contraction (negative thermal expansion) in addition, the CMP pad may undergo further conversion forming polymer from residual polymer precursors and similarly contract. The additional degree of conversion if polymerization may be at least 0.01% or greater, such as in the range of 0.01% to 1.99%, including all values and ranges therein. After thermal treatment, the groove depth and groove width may expand the same amount or different amounts as illustrated in FIG. 5.

In the present disclosure, the relationship between the initial width dimension for the cut groove ($W_1$) and the final width ($W_2$) (due to further curing and/or heat treatment) may be expressed as follows: $(W_1) \leq (X)(W_2)$, where the value of (X) is in the range of 0.01 to 0.75, in 0.01 increments. Preferably, the value of (X) is in the range of 0.50 to 0.75 in 0.01 increments. Similarly, in the case of depth, the relationship between the initial depth dimension for the cut groove ($D_1$) and the final width ($D_2$) (due to curing and/or heat treatment) may be expressed as follows: $(D_1) \leq (Y)(D_2)$, where the value of (Y) is in the range of 0.80 to 0.95, in 0.01 increments. In the case of land length, the relationship between the initial land length ($L_1$) and the final land length ($L_2$) (due to curing and/or heat treatment) may be expressed as follows $(L_1) \geq (Z)(L_2)$ wherein (Z) has a value of 1.1 to 1.4, in 0.01 increments.

Therefore, in one example, the initial groove width ($W_1$) may be in the range of 5 mils to 10 mils (127 μm to 254 μm) and after thermal treatment may exhibit a second groove width ($W_2$) of 10 mils to 20 mils (254 μm to 508 μm). The initial groove depth ($D_1$) may be 40 mils (1016 μm) and after thermal treatment may exhibit a second groove depth ($D_2$) of 45 mils (1143 μm). The initial land length ($L_1$) may be 95 mils to 120 mils (2413 μm to 3048 μm) and after thermal treatment may exhibit a length ($L_2$) of 85 mils to 90 mils (2159 μm to 2286 μm). It is noted that the deeper the cut groove depth ($D_1$), the wider ($W_2$) the final groove may be, particularly at the intersection of the groove and the pad surface.

While not being limited to any particular theory, the thermal treatment process may result in the shrinkage of the lands between the grooves. Therefore, by controlling groove dimensions through, not only material removal, but also through shrinkage of the lands between the grooves, less material may be removed from the pad. This reduces the cost and productivity losses of providing the CMP pads by conserving cutting blades, extending cutting blade life, and reducing groove time. It may be appreciated that in some examples, to achieve a specific final groove volume, less than 50% of the material volume need be removed from the pad surface.

Figure 6:
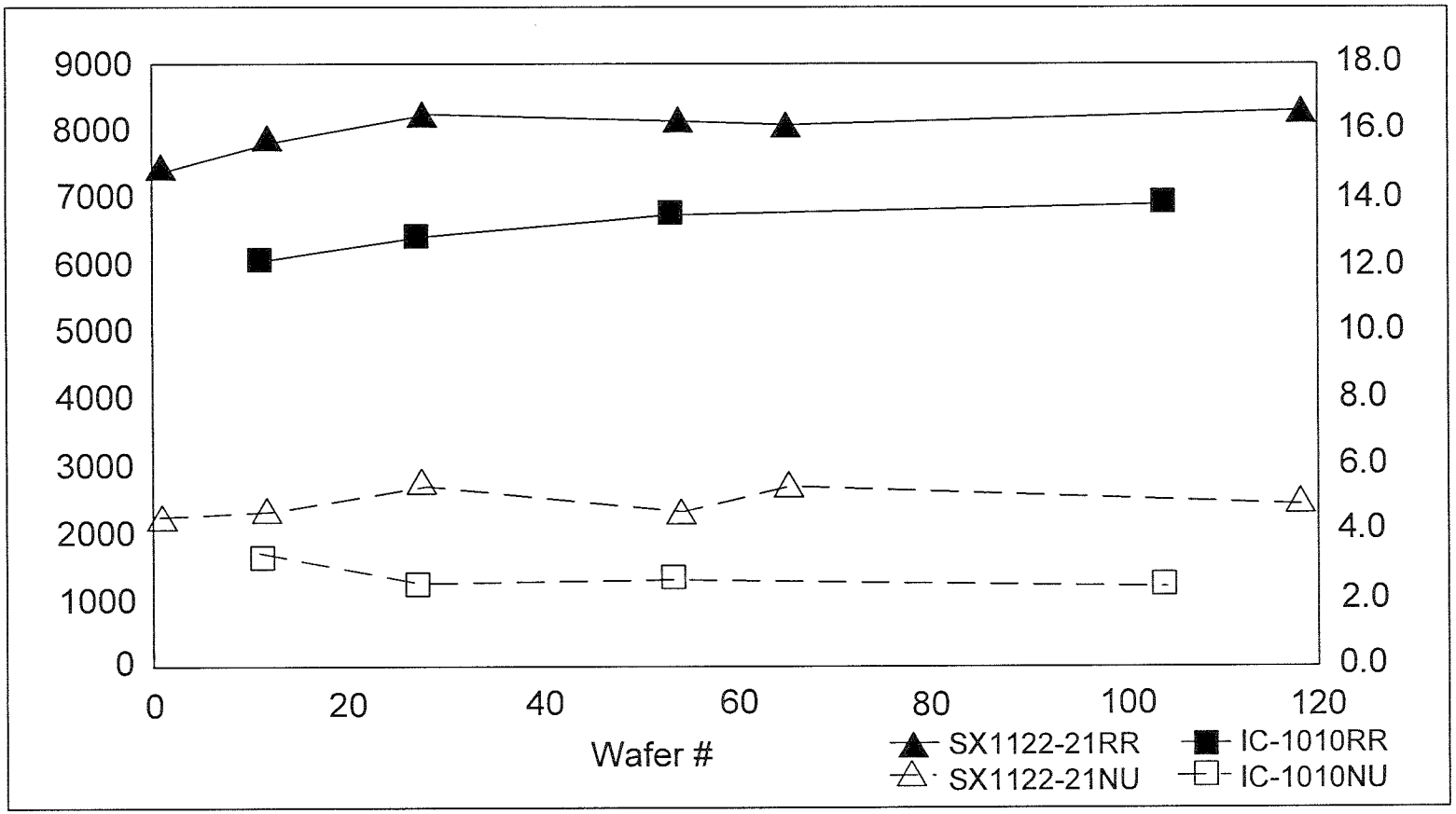
FIG. 6 illustrates the removal rate (RR) in Angstroms/minute for the RR of SX1122-21.

In such regard, reference is made to FIG. 6, which illustrates the removal rate (RR) in Angstroms/minute for the RR of SX1122-21, having a groove width of 508 microns, a groove depth of 762 microns, and a pitch of 2159 microns. As can be seen, such pad characteristics provided a relatively higher removal rate as compared to the RR of IC-1010, which has a groove width of 508 microns, a groove depth of 762 microns, and a pitch of 2286 microns. In addition, it may be noted that SX1122-21 maintained a non-uniformity (NU) of less than 6.0%, which is considered acceptable for pad polishing. Reference to the parameter NU is reference to a variation in thickness of the polished wafer.

Figure 7:
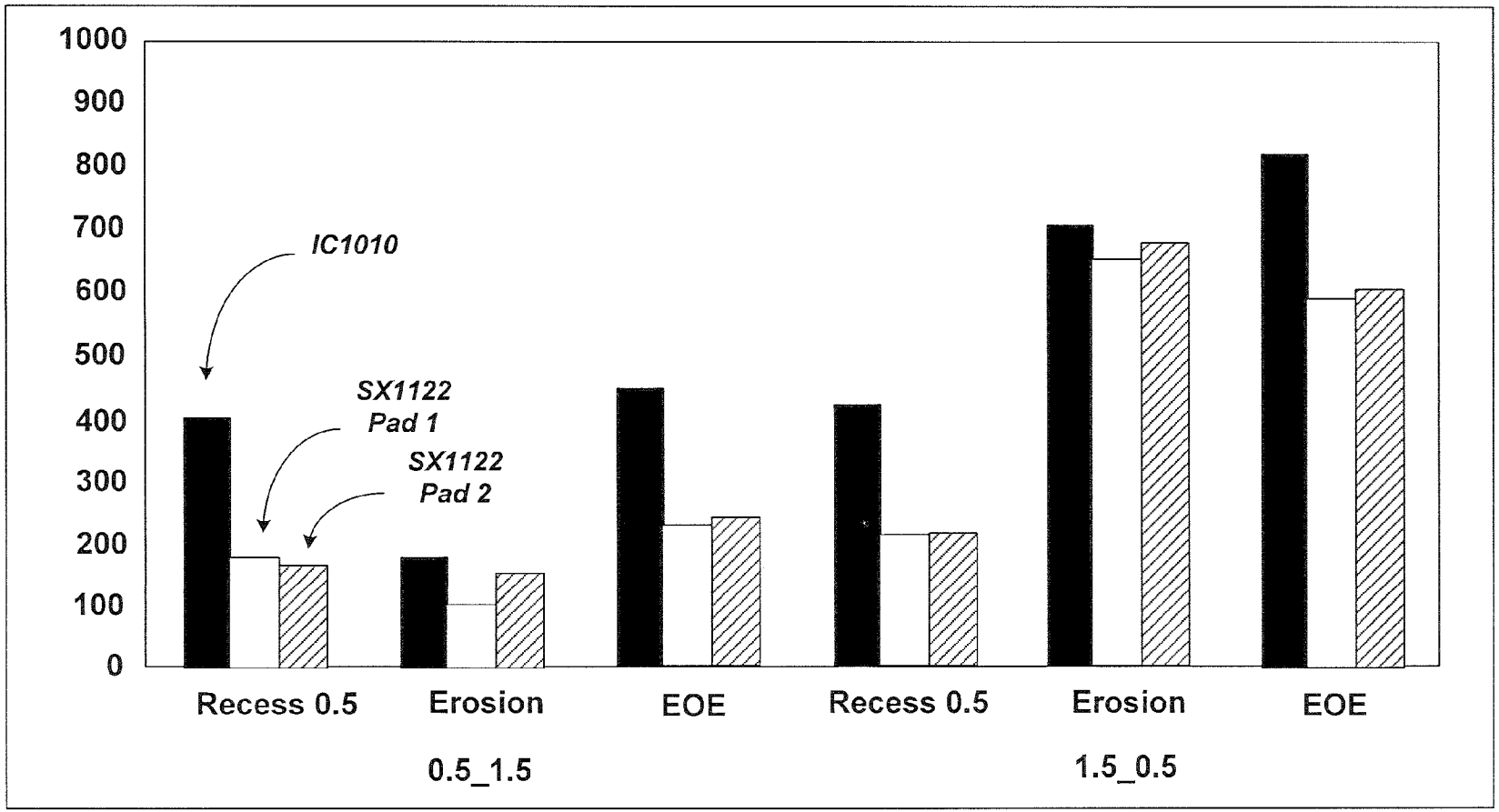
FIG. 7 illustrates comparative data regarding the SX1122 pad versus IC-1010.

Attention is next directed to FIG. 7 which provides further comparative data regarding the SX1122 pad, noted above (two pad samples) versus IC-1010 available from Rohm & Haas. The parameters evaluated were "Recess 0.5" which is reference to the distance between the top of the insulating region on the pad to the adjoining 0.5 micron conductive trace. As can be seen, IC1010 indicated this vertical measurement to be 400 Angstroms, whereas the SX1122 indicated a vertical measurement of between 150-200 Angstroms. The parameter of "Erosion" is also shown, which may be understood as the undesirable excess removal of the insulation layer. As can be seen, IC1010 had a vertical measurement of about 175 Angstroms, whereas the SX1122 indicated vertical measurements of about 100 Angstroms (pad 1) or about 150 Angstroms (pad 2). The parameter of EOE or "Edge on Erosion" indicates a horizontal measurement reflecting a non-effective polishing area located on the perimeter of a given pad. As can be seen, IC1010 had an EOE of about 425 Angstroms, whereas the SX122 indicated values of about 200-225 Angstroms.

Figure 8:
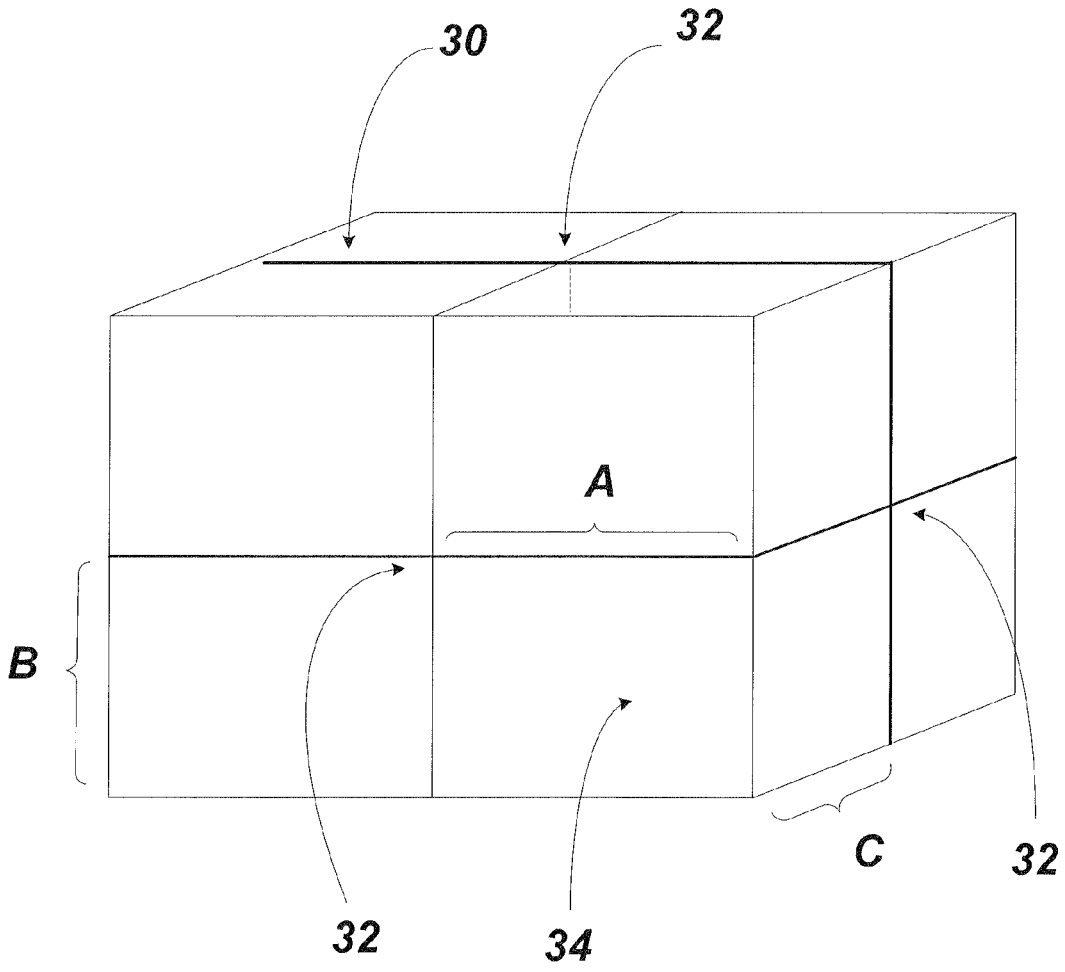
FIG. 8 illustrates an example of an embedded structure portion of a pad incorporating a three dimension structure within a given pad.

As alluded to above, the embedded structure portion of the pad herein may be understood as incorporating a three-dimensional structure with a given pad, one example of which is shown in FIG. 8. As can be seen, it may include interconnecting polymer elements 30 along with a plurality of junction locations 32. Within the three-dimensional structure (i.e. the interstices) may be a particular polymeric binder material 34 (i.e., the polymer matrix) which, when combined with the three-dimensional interconnecting polymer elements 30, provide the polishing pad substrate. In addition, although the network is shown with a relative square or rectangular geometry, it may be appreciated that it may include other types of structures, including, but not limited to oval, round, polyhedral, etc.

In addition, a further aspect of this invention is the use of multiple three-dimensional embedded structural networks along with an integrally formed window which network may affect different physical and chemical property domains within the same pad. Accordingly, one may vary the chemical (polymeric) composition noted above for the embedded structural elements 30 and/or physical features of such elements. Such physical features may include the spacing of the elements 30, and or the overall shape of the embedded structural elements, as explained more fully below.

It is worth noting that advanced semiconductor technology requires packing a large number of smaller devices on the semiconductor wafer. Greater device density in turn requires greater degrees of local planarity and global uniformity over the wafer for depth of focus reasons in photo lithography. The three-dimensional structural network and window configuration in the present invention may therefore enhance the mechanical and dimensional stability of the CMP pad over conventional, non-network based CMP pad structures. The three-dimensional embedded structure herein with an integrally formed window may also better withstand the compressive and viscous shear stress of the polishing action, resulting in the desired degree of local planarity and global uniformity as well as low wafer scratching defects, as the surface deformation of the pad is reduced.

As alluded to above, the actual three-dimensional embedded structure within the pad can also be customized for a particular CMP application by varying the type of polymeric materials, the dimensions of the interconnecting and embedded elements, and the size and shape of the elements. In addition, various chemical agents including, but not limited to, surfactants, stabilizers, inhibitors, pH buffers, anti-coagulants, chelating agents, accelerators and dispersants may be added to the surface or bulk of the pad, so that they can be released in a controlled or uncontrolled manner into an abrasive slurry or polishing fluid to enhance CMP performance and stability.

One exemplary embodiment of the present invention comprises a polyurethane substance dispersed and partially or completely filling the interstices of a three-dimensional network made up of water-soluble (e.g. polyacrylate) embedded and interconnecting and embedded structural elements. The interconnecting elements within the pad and dispersed in the polyurethane may have a cylindrical shape with diameters from below 1 micron (e.g. 0.1 microns) to about 1000 microns, and what may be described as a horizontal length between adjacent interconnecting junctures ranging from 0.1 microns and higher (e.g. junctures with a horizontal length therebetween ranging from 0.1 microns to 20 cm, including all values and increments therein). This length between interconnecting junctures is show as item "A" in FIG. 8. In addition, what may be described as the vertical distance between interconnecting junctures is shown as item "B" in FIG. 8, and this may also vary as desired from 0.1 microns and higher (e.g., junctures having a vertical length therebetween ranging from 0.1 microns to 20 cm, including all values and increments therein). Finally, in what may described as a depth distance between junctures is shown as item "C" in FIG. 8, and again, this may also vary as desired from 0.1 microns and higher (e.g. junctures having a depth distance therebetween ranging from 0.1 microns to 20 cm, including all values and increments therein).

The three-dimensional embedded structure itself may be in the form of a thin square or circular slab with thickness in the range of 10 to 6000 mils and preferably between 60 to 130 mils, and an area between 20 to 4000 square inches and preferably between 100 to 1600 square inches, including all values and increments therein. A urethane pre-polymer mixed with a curing agent may be used to fill the interstices of the embedded structure, and the composite is then cured in an oven to complete the curing reaction of the urethane pre-polymer. Typical curing temperature ranges from room temperature to 800 deg F., and typical curing time ranges from as little as under an hour to over 24 hours. The resulting composite is then converted into a CMP pad using conventional pad converting processes such as buffing, skiving, laminating, grooving and perforating.

The embedded structure may also be available in the form of a cylinder or rectangular block in the above mentioned embodiment. It follows, then, that the composite comprising the embedded structure herein filled with urethane pre-polymer mixed with curing agent may also be cured in the form of a cylinder or rectangular block. In this case, the cured composite cylinder or block may first be skived to yield individual pads before converting.

Another embodiment of the present invention comprises two or more embedded structures having different thicknesses, the embedded structures further differentiated from each other by the types of polymeric material contained therein. For example, one portion of the pad included a first embedded structure may have a thickness of 1-20 centimeters and a second portion of the pad including a second embedded structure may have a thickness of 1-20 cm, each including all values and increments therein. The embedded structures within the same CMP pad then may define different pad domains having different physical and chemical properties, due to a selected difference in the chemical or physical properties of the embedded structures. For example, the first embedded structure may be selected from a first polymer and the second embedded structure may be selected from a second polymer, where the polymers differ in chemical repeating unit structure. A difference in chemical repeating unit composition may be understood as a difference in at least one element of the repeating unit, as between the two polymers selected, or a difference in the number of elements in the repeating units. For example, the first and second polymer may be selected from polymers such as polyesters, nylons, cellulosics, polyolefins, polyacrylates, modified acrylic fibers such as polyacrylonitrile based fibers, polyurethanes, etc.

One example would include a CMP pad having a first 20 mils thick region comprising embedded structure of soluble polyacrylate fibers in relatively small cylindrical form 10 microns diameter and 50 to 150 microns apart from each other that is stacked onto a second embedded structure comprising polyester fibers in the same cylindrical form and having the same dimensions as for the said first polyacrylate network of fibers. A urethane pre-polymer mixed with a curing agent may then be used to fill the interstices of the stacked fiber networks, and the entire composite is cured as mentioned above. The resulting composite is then converted into a CMP pad using conventional pad converting processes such as buffing, skiving, laminating, grooving and perforating. The CMP pad made in this manner has therefore two distinctly different but attached structural layers stacked on one another. In CMP, the layer comprising the soluble polyacrylate fibrous elements may be used as the polishing layer. The soluble polyacrylate elements may dissolve in the aqueous slurry containing the abrasive particles, leaving void spaces on and under the surface of the pad creating micron sized channels and tunnels for even distribution of the slurry throughout the pad. The layer containing the relatively insoluble polyester elements, on the other hand, may be employed as the supporting layer to maintain mechanical stability and bulk pad properties in CMP.

The aforementioned embodiments notwithstanding, it is recognized herein that one who is skilled in the art of CMP pad design, manufacture and application can readily appreciate the unexpected properties by the incorporation of the structural network into a CMP pad, and can readily derive, based on the present invention, a multitude of pad designs using the same concept with various types of network materials, structure, and polymeric substances in the same pad to meet the requirements of particular CMP applications.

What is claimed is:

1. A method of forming a chemical-mechanical planarization pad, comprising:

polymerizing one or more polymer precursors and forming a chemical-mechanical planarization pad including a surface;

removing material from the surface of said pad to form grooves in said surface and lands between said grooves, wherein said grooves have a first width ($W_1$); and shrinking said lands from a first land length (L1) at said surface to a second land length (L2) at said surface, wherein said second land length (L2) is less than said first land length (L1) and said grooves have a second width ($W_2$) wherein ($W_1$)≤(X) ($W_2$), wherein (X) has a value in the range of 0.01 to 0.75;

wherein shrinking said lands comprises further polymerizing said polymer precursors after forming grooves in said surface.

2. The method of claim 1, wherein said grooves have a first depth (D1) and after shrinking have a second depth ($D_2$) wherein (D1)≤(Y)($D_2$) and (Y) has a value in the range of 0.80 to 0.95.

3. The method of claim 1, wherein said (L1)≥(Z)(L2) and (Z) has a value in the range of 1.1 to 1.4.

4. The method of claim 1, wherein shrinking said lands comprises heating said chemical-mechanical planarization pad at a temperature in the range of 110° F. to 400° F. for a period of time.

5. The method of claim 4, wherein shrinking said lands further comprises cooling said chemical-mechanical planarization pad at a temperature of 80° F. to 150° F. for a period of time.

6. The method of claim 1, wherein said chemical-mechanical planarization pad includes at least one embedded structure in a polymer matrix.

7. The method of claim 6, wherein said embedded structure is not present in at least a portion of said polymer matrix and said chemical-mechanical planarization pad includes a window integral to said pad defined by said portion of said pad where said embedded structure is not present.

8. The method of claim 6, wherein said at least one embedded structure includes soluble material.

9. A method of forming chemical-mechanical planarization pad, comprising:

forming a chemical-mechanical planarization pad including a surface, wherein said chemical-mechanical planarization pad is formed by polymerizing polymer precursors to a selected degree of conversion;

removing material from the surface of said pad to form one or more grooves in said surface and lands between said grooves, wherein said grooves have a first width ($W_1$) and a first depth (D1); and thermally treating said chemical-mechanical planarization pad with said grooves formed in said surface, increasing said degree of conversion, and shrinking said lands wherein said grooves exhibit a second width ($W_2$) and a second depth ($D_2$), wherein said second width ($W_2$) is greater than said first width ($W_1$) and said second depth ($D_2$) is greater than said first depth (D1).

10. The method of claim 9, wherein said lands have a first length (L1) at said surface and after shrinking have a second length (L2) at said surface, wherein said second land length (L2) is less than said first land length (L1) wherein (L1)≥(Z)(L2) and (Z) has a value in the range of 1.1 to 1.4.

11. The method of claim 9, wherein thermally treating said chemical-mechanical planarization pad includes at least partially immersing said chemical-mechanical planarization pad in a liquid bath or an oven.

12. The method of claim 9, wherein thermally treating said chemical mechanical planarization pad includes heating said pad at a temperature in the range of 110° F. to 400° F. for a period of 10 hours or greater.

13. The method of claim 9, wherein thermally treating said chemical mechanical planarization pad includes heating said pad at a temperature in the range of 160° F. to 190° F. for a period of 16 hours to 90 hours.

14. The method of claim 9, wherein thermally treating said chemical-mechanical planarization pad includes cooling said chemical-mechanical planarization pad at an intermediate temperature in the range of 80° C. to 150° C. for a period of 10 minutes or greater.

15. The method of claim 9, wherein thermally treating said chemical-mechanical planarization pad includes cooling said chemical-mechanical planarization pad at an intermediate temperature in the range of 100° F. to 130° F. for a period of 10 minutes to 120 minutes.

16. The method of claim 9, wherein said chemical-mechanical planarization pad includes at least one embedded structure in a polymer matrix.

17. The method of claim 16, wherein said embedded structure is not present in at least a portion of said polymer matrix and said chemical-mechanical planarization pad includes a window integral to said pad defined by said portion of said pad where said embedded structure is not present.

18. The method of claim 16, wherein said embedded structure comprises one or a plurality of fibers.

19. The method of claim 16, wherein said at least one embedded structure includes soluble material.

* * * * *